United States Patent [19]

Masaki

[11] 4,133,174

[45] Jan. 9, 1979

[54] METHOD OF REDUCING POLLUTANTS IN ENGINE EXHAUST GAS BEFORE EMISSION INTO THE ATMOSPHERE

[75] Inventor: Kenji Masaki, Yokohama, Japan

[73] Assignee: Nissan Motor Company, Ltd., Japan

[21] Appl. No.: 748,174

[22] Filed: Dec. 7, 1976

Related U.S. Application Data

[63] Continuation of Ser. No. 521,197, Nov. 5, 1974, abandoned.

[51] Int. Cl.[2] ..... F01N 3/10

[52] U.S. Cl. ..... 60/285; 60/282

[58] Field of Search ..... 60/274, 282, 285, 303; 123/53 A, 53 R, 59 A, 59 PC, 119 LR

[56] References Cited

U.S. PATENT DOCUMENTS

| | | | |
|---|---|---|---|
| 3,200,800 | 8/1965 | DuBois | 123/59 A |
| 3,708,980 | 1/1973 | Truxell | 60/274 |
| 3,805,523 | 4/1974 | Tanasawa | 60/298 |
| 3,827,237 | 8/1974 | Linder | 60/285 |

*Primary Examiner*—Louis J. Casaregola

[57] ABSTRACT

In an engine having an even number of cylinders, the cylinders are divided into two groups each consisting of half the number of the total cylinders, and the two groups are fed with a considerably rich air-fuel mixture and a lean one, respectively. Each of the one group of cylinders is arranged to discharge an exhaust gas rich in HC and CO simultaneously with discharge of another exhaust gas rich in air from a predetermined cylinder of the other group, and the exhaust gases are mixed and reacted with each other in the engine exhaust system.

10 Claims, 4 Drawing Figures

METHOD OF REDUCING POLLUTANTS IN ENGINE EXHAUST GAS BEFORE EMISSION INTO THE ATMOSPHERE

This is a continuation of application Ser. No. 521,197, filed Nov. 5, 1974 (abandoned).

This invention relates to a method of reducing concentrations of harmful substances in multi-cylinder internal combustion engine exhaust gases.

Concentrations of harmful substances in an internal combustion engine exhaust gas are greatly dependent on the air to fuel ratio of a combustible mixture fed to the engine. As is known, the production of nitrogen oxides (NOx) can be suppressed by employment of either a considerably high or low air to fuel ratio since highest concentrations of NOx are produced around the stoichiometric ratio. On the other hand, concentrations of unburned fuel or hydrocarbons (HC) and carbon monoxide (CO) decrease as the air to fuel ratio is increased or, in other words, when a lean mixture is used. It is, however, quite difficult to reduce concentrations of HC and CO in the exhaust gas to values low enough to meet current requirements merely by employment of a considerably lean mixture. Accordingly, an engine exhaust gas is frequently subjected to secondary or after-burning in the exhaust system, usually using a thermal reactor, to convert the discharged HC and CO into harmless oxides. HC and CO, particularly the latter, however, show extremely poor reactivity with air in low concentrations and/or at relatively low temperatures. A rich combustible mixture is more favorable when the after-burning is carried out because the resulting high concentrations of HC and CO in the exhaust gas allow the after-burning to proceed more completely while the concentration of NOx is inherently decreased as mentioned above. For practical application, however, a rich mixture is quite unvaborable from the viewpoint of fuel economy.

It is therefore a general object of the present invention to provide a method of effectively reducing concentrations of harmful substances in an exhaust gas from a typical internal combustion engine having an even number of combustion chambers before emission into the atmosphere, which method is accompanied with substantially no increase in fuel consumption.

According to the invention with respect to an internal combustion engine having an even number of combustion chambers, the combustion chambers are divided into first and second groups each consisting of one half of the total combustion chambers. The first group is fed with a first air-fuel mixture of an air-fuel ratio substantially below the stoichiometric ratio and the second group with a second mixture of another air fuel ratio substantially above the stoichiometric ratio. The engine is operated in such a manner that each of the first group of combustion chambers discharges a first exhaust gas simultaneously with discharge of a second exhaust gas from a predetermined combustion chamber of the second group, and the first and second exhaust gases are mixed with each other in the engine exhaust system to cause HC and CO in the exhaust gases to react with excess air in the second exhaust gas. A thermal reactor is preferably used to carry out the exhaust gas mixing and resulting reactions.

The NOx concentration can be extremely reduced since the air to fuel ratios of both the first and second mixtures substantially deviate from the stoichiometric ratio. The first group of combustion chambers or cylinders discharge a first exhaust gas containing relatively large amounts of HC and CO and the second group a second exhaust gas containing a relatively large amount of hot air. These two differently composed exhaust gases are always discharged from the engine simultaneously, so that they can be easily mixed with each other in the exhaust system, resulting in occurrence of vigorous oxidation reactions at relatively high temperatures. Thus, HC and CO can be almost completely eliminated before emission into the atmosphere.

The invention will be fully understood from the following detailed description of preferred embodiments thereof with reference to the accompanying drawings, in which.

Figure 1:
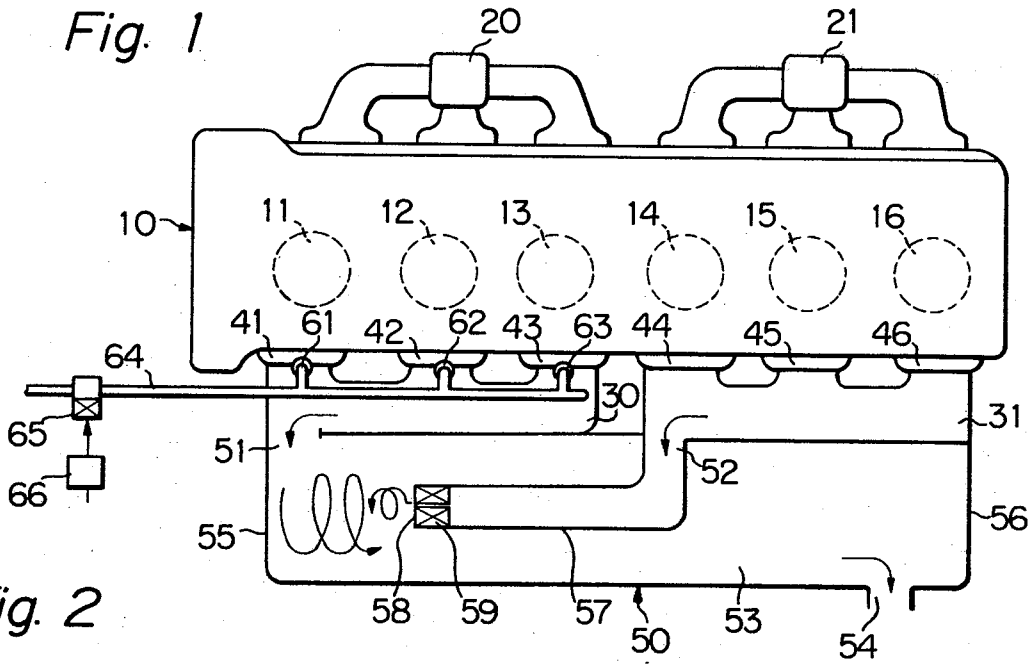
FIG. 1 is a diagrammatic plan view, partly in section, of an assembly of six-cylinder engine and a thermal reactor, showing a first preferred arrangement for the method of the invention.

Referring to FIG. 1, a six-cylnder engine 10 is provided with two carburetors 20 and 21. In this engine 10, three cylinders or combustion chambers 11, 12 and 13, which are located on the left side of the engine 10 in the drawing and adjoined in the order of the reference numerals, constitute a first cylinder group, and the remaining three cylinders 14, 15 and 16 located on the right side in the order of the numerals make up a second group. The first carburetor 20 supplies a relatively rich air-fuel mixture having an air-fuel ratio substantially lower than the stoichiometric ratio, e.g., about 12/1, to the first group of cylinders 11–13, and the second carburetor 21 a relatively lean mixture having an air/fuel ratio substantially higher than the stoichiometric ratio, e.g., 18/1, to the second group of cylinders 14–16. Alternatively, the carburetors 20 and 21 may be replaced by a conventional fuel injection system (not shown). In accordance with the invention, the engine 10 is arranged such that each cylinder 11, 12 or 13 of the first group is fired simultaneously with a predetermined cylinder 14, 15 or 16 of the second group. In the case of FIG. 1, the cylinders 11 and 16 are fired firstly, next the cylinders 13 and 14, and then the cylinders 12 and 15. The ignition timing, valve timing and crankshaft (not shown) configuration of the engine 10 are arranged to enable the cylinders 11–16 to be fired two specific ones at a time and in the above-indicated sequence.

The engine 10 is equipped with two exhaust manifolds, the first 30 and second 31 of which are communicable with the first group of cylinders 11–13 and with the second group 14–16, respectively, through exhaust ports 41-46 of the respective cylinders 11–16. A thermal reactor 50 is assembled with the exhaust manifolds 30 and 31, providing communication with inlets 51 and 52, respectively. The interior space 53 to serve as a reaction chamber is preferably generally cylindrical, and the first inlet 51 and an outlet 54 are formed near an end 55 and the opposite end 56 thereof, respectively. The second inlet 52, which is located at the middle section of the reaction chamber 53, is not directly exposed to the reaction chamber 53, but connected with a tube 57. The tube 57 extends towards the end 55, so that an open end 58 thereof is located close to the first inlet 51. The opening 58 is preferably on the longitudinal axis of the reaction chamber 53, and a swirl vane 59 is disposed in the tube 57 adjoining the opening 58.

In operation, combustion and exhaust cycles of the pair of cylinders 11 and 16 are carried out simultaneously, so that the exhaust gases flow into the two exhaust manifolds 30 and 31 simultaneously. Since the two cylinders 11 and 16 are fed with a rich and a lean air-fuel mixture, respectively, a first exhaust gas flowing into the first manifold 30 contains relatively large amounts of HC and CO while a second exhaust gas into the second manifold 31 contains a large excess of hot air. The first exhaust gas flows into the reaction chamber 53 through the first inlet 51, and the second exhaust gas is soon thereafter blown from the opening 58 of the tube 57 as a swirling flow. Then the first and second exhaust gases meet and mix with each other, causing vigorous after-burning reactions between the excess air in the second exhaust gas and HC and CO in the first exhaust gas to occur. The reactions proceed during subsequent flow of the mixed exhaust gases towards the opposite end 56 of the reaction chamber 53 and are completed before discharge of the exhaust gases from the outlet 54 of the reactor 50.

Figure 2:
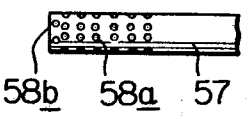
FIG. 2 is a partial plan view of an exhaust gas ejection tube for the thermal reactor of FIG. 1.

In order to promote the initial mixing of the first and second exhaust gases, the first inlet 51 is preferably arranged in such a manner that the first exhaust gas enters the cylindrical reaction chamber 53 in the tangential direction thereof to produce a swirling flow of the same direction as the second exhaust gas flow due to the swirl vane 59. Alternatively, the outlet 58 of the tube 57 may be modified as shown in FIG. 2. The swirl vane 59 of FIG. 1 is omitted in this modification, and a multiplicity of tiny holes 58*a* are formed in the peripheral wall of the tube 57 at locations near the closed end 58*b* thereof. The second exhaust gas jets through the holes 58*a* and mixes with the first exhaust gas flowing around the tube 57.

Another pair of cylinders 13 and 14 are fired simultaneously subsequently to the firing of the cylinders 11 and 16, and then follows the action of the remaining pair of the cylinders 12 and 15, causing the above described reactions in the thermal reactor 50 to be repeated.

Since relatively large amounts of HC and CO are burned in the thermal reactor 50 when the excess air in the second exhaust gas is still at a considerably high temperature, the reactions in the reaction chamber 53 proceed at considerably high temperatures and result in almost thorough elimination of HC and CO originally contained in the first and second exhaust gases. As the concentration of NOx is inherently reduced by employment of the first and second air-fuel mixtures both substantially deviating from the stoichiometric mixture, the exhaust gas discharged from the thermal reactor 50 is remarkably clean.

It will be apparent that the apportionment of the first or rich air-fuel mixture to the first group of cylinders 11–13 and the second or lean mixture to the second group 14–16 may be reversed with the same result. Furthermore, it is to be understood that the method of the invention does not necessarily require the use of the thermal reactor 50, but the first and second exhaust gases may be mixed and reacted within one exhaust manifold (not shown) communicable with all the cylinders 11–16.

Referring again to FIG. 1, the first exhaust manifold 30 is preferably equipped with secondary or auxiliary air nozzles 61, 62 and 63 at locations close to the exhaust ports 41, 42 and 43, respectively. An air duct 64 for these nozzles 61–63 is under the control of a solenoid valve 65, which is normally closed and is energized to its open position by a control unit 66 having means to sense the engine load and a switch. U.S. Pat. No. 3,680,318 (Nakajima et al.) is cited as an example of a control system with such a load responsive control feature. When the engine 10 is idling or operating at relatively low loads, the first exhaust gas will be at such a low temperature as to be unfavorable for the reactions in the thermal reactor 50. Then, the control unit 66 operates the valve 65 to feed auxiliary air into the first exhaust manifold 30 when the load on the engine 10 falls below a predetermined value. As a result, a portion of HC in the first exhaust gas is burned within the exhaust manifold 30, allowing the exhaust gas temperature to rise sufficiently prior to feeding of the exhaust gas into the reactor 50.

Either the grouping of the cylinders 11–16 or the arrangement of the thermal reactor 50 can be modified variously in a method of the invention. In a second arrangement shown in FIG. 3, the three cylinders 11, 13 and 15 and the remaining three cylinders 12, 14 and 16 constitute the first and second groups, respectively. In other words, the first and second groups of cylinders are arranged alternately. The three pairs of cylinders 11–12, 13–14 and 15–16 are fired simultaneously, respectively, in the written order. The ignition timing, valve timing and crankshaft configuration of the engine 10*a* are modified from those of the engine 10 of FIG. 1 to allow such grouping and firing order. An exhaust manifold 33 is arranged to allow the exhaust gases from all the cylinders 11–16 to pass therethrough. A thermal reactor 50*a* has a generally cylindrical reaction chamber 53, an inlet 51 formed close to one end 55 of the reaction chamber 53 and an outlet 54 near the opposite end 56. In this arrangement, the first and second exhaust gases from each cylinder pairs 11–12, 15–16 or 13–14 begin to mix with each other in the exhaust manifold 33 and then flow into the reaction chamber 53. Thereafter the burning reactions as described with respect to FIG. 1 proceed and are completed in the reaction chamber 53. The simplified construction of the exhaust manifold 33 and reactor 50*a* are characteristic of this arrangement.

Figure 3:
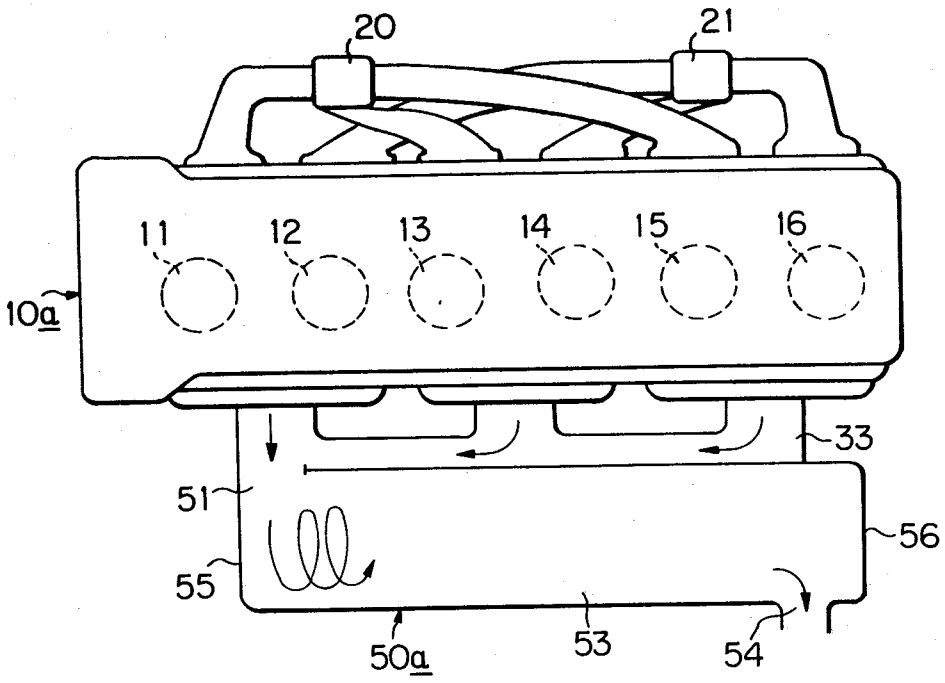
FIG. 3 is a diagrammatic plan view similar to, but slightly modified from FIG. 1, showing a second preferred arrangement for the method of the invention.
Figure 4:
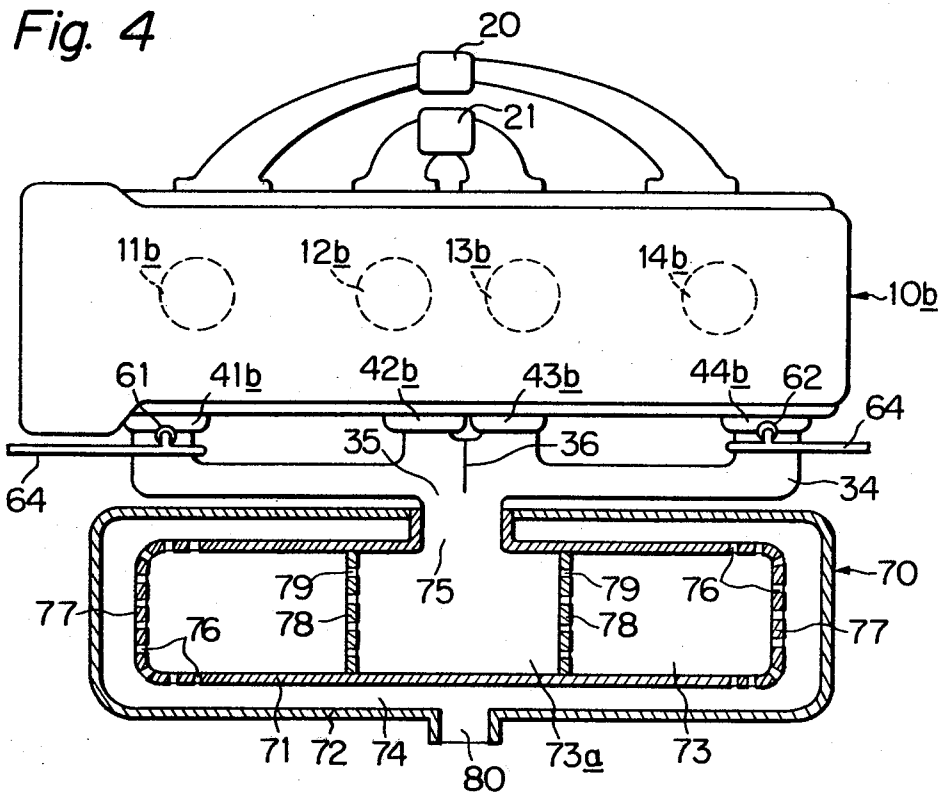
FIG. 4 is a plan view, partly in section, of an assembly of a four-cylinder engine and a thermal reactor as a third preferred arrangement for the method of the invention.

FIG. 4 illustrates another arrangement for the method of the invention with respect to a four-cylinder engine 10*b*. Two cylinders 11*b* and 14*b* are fed with the rich air-fuel mixture while the remaining two cylinders 12*b* and 13*b*, which are located between the cylinders 11*b* and 14*b*, are fed with the lean mixture. The apportionment of the rich and lean mixtures may of course be reversed. The engine 10*b* is arranged such that the cylinders 11*b* and 12*b* are fired at the same time and then the cylinders 13*b* and 14*b* are fired simultaneously. An exhaust manifold 34 is communicable with all the cylinders 11*b*–14*b* and has an outlet 35. The interior of the exhaust manifold 34 is preferably divided into two sections by a dividing wall 36 to allow the exhaust gases to be quickly discharged from the outlet 35. The thermal reactor 50*a* of FIG. 3 may be assembled with this exhaust manifold 34. FIG. 4, however, shows a different type of thermal reactor 70, which is made up of a cylindrical inner body 71 and a cylindrical outer body 72 with a reaction chamber 73 in the inner body 71 and a space 74 between the two bodies 71 and 72. The two cylindrical bodies 71 and 72 are generally arranged coaxially with each other. The reaction chamber 73 communicates with the outlet 35 of the exhaust manifold 34 through an inlet 75 formed in the middle of the peripheral wall of the inner body 71. The inlet 75 extends through the space 74 and the wall of the outer body 72 in a manner as to be isolated from the space 74. A plurality of holes 76 formed through the wall of the inner body 71 at both ends 77 and peripheral regions close thereto provides the communication between the reaction chamber 73 and the space 74. Two partitions 78 are preferably disposed in the reaction chamber 73 at locations between the inlet 75 and the ends 77 to divide the reaction chamber 73 into three sections. A plurality of through holes 79 in the partitions 78 allow the thus formed central section **73*a* to communicate with the remaining sections of the reaction chamber 73. The outer body 72 has a discharge port 80** in the middle of the peripheral wall thereof.

In operation, the two differently composed exhaust gases flow into the exhaust manifold 34 when, e.g., the pair of cylinders **11*b* and 12*b* work simultaneously. The two exhaust gases begin to mix with each other during passing through the inlet 75 to enter the central section 73*a* of the reaction chamber 73. Due to retardation of the exhaust gas flow by the partitions 78, a thorough mixing of the two exhaust gases is attained and stable burning reactions can be established in the central section 73*a*. The burning reactions proceed during the subsequent flow of the mixed exhaust gases from the central section 73*a* to the side sections of the reaction chamber 73 through the holes 79. Then the exhaust gases, either still reacting or completely reacted, flow into the space 74 through the holes 76 and round towards the middle of the reactor 70, where the discharge port 80** is disposed.

Such a long gas path in the thermal reactor 70 allows the mixed exhaust gases to remain therein for a period long enough to accomplish practically thorough oxidation of HC and CO contained initially therein. Besides affording a long reaction time, the passage of the heated exhaust gases around the inner body 71 causes the reaction chamber 73 to be maintained at elevated temperatures, so that the oxidation reactions can be initiated with ease and proceed smoothly.

The air nozzles 61 and 62 for the above described auxiliary air may be provided in the exhaust manifold 34 at locations close to exhaust ports **41*b* and 44*b* of the cylinders 11*b* and 14*b*** which are fed with the rich mixture.

It will be understood that the grouping of cylinders of four-cylinder engines for feeding of the rich and lean mixtures according to the invention may follow either the grouping of FIG. 1 or that of FIG. 3. Also, it will be apparent that any of the thermal reactors 50, **50*a* and 70 can be used for any engine arranged in accordance with the invention with the corresponding modification of the exhaust manifold for the engine. Besides, either the thermal reactor 50 or 50*a* may be modified to have an outer body and a space between the two bodies like the thermal reactor 70**.

What is claimed is:

1. An engine system including an internal combustion engine having an even number of combustion chambers of the same construction and function said combustion chambers being divided into a first group and a second group, each consisting of one half of the total combustions chambers, said system comprising:

means for supplying a first air-fuel mixture having an air/fuel ratio substantially below the stoichiometric ratio and the second air-fuel mixture of an air/fuel ratio substantially above the stoichiomtric ratio to said first group and said second group respectively simultaneously in predetermined sequential order within each group;

means for simultaneously selectively igniting a predetermined chamber of each group;

a thermal reactor having a cylindrical reaction chamber having inlet means including at least one inlet and an outlet, said outlet disposed at essentially the other end of said chamber from at least one said inlet, said inlet means simultaneously admitting exhaust gases from each group of said combustion chambers;

a first exhaust manifold through which said first group of combustion chambers communicate with said inlet means of said thermal reactor;

means for introducing secondary air into said first exhaust manifold when the engine load falls below a predetermined value.

2. The engine system of claim 1 in which said first group and second of chambers are sequentially arranged.

3. The engine system of claim 1 in which the air-fuel mixture supplying means are carburetors.

4. The engine system of claim 1 in which the air-fuel mixture supplying means are fuel injectors.

5. The engine system of claim 1 in which a second exhaust manifold communicates with said inlet means.

6. The engine system of claim 1 in which the inlet means has a first and a second inlet with said second inlet in indirect communication with said reaction chamber.

7. The engine system of claim 1 in which said second inlet is operatively connected to gas swirling means located near said first inlet.

8. The engine system of claim 7 in which said swirling means include a swirl vane.

9. The engine system of claim 7 in which said swirling means include a perforated tube.

10. The engine system of claim 1 in which said groups of chambers are alternately arranged with adjacent pairs of chambers igniting in unison.

* * * * *